US010164366B2

(12) United States Patent
Kataoka

(10) Patent No.: US 10,164,366 B2
(45) Date of Patent: Dec. 25, 2018

(54) CONNECTOR TERMINAL AND ELECTRIC CONNECTOR

(71) Applicant: Japan Aviation Electronics Industry, Limited, Tokyo (JP)

(72) Inventor: Tomoki Kataoka, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/724,692

(22) Filed: Oct. 4, 2017

(65) Prior Publication Data

US 2018/0138622 A1 May 17, 2018

(30) Foreign Application Priority Data

Nov. 14, 2016 (JP) ..... 2016-221641

(51) Int. Cl.
*H01R 11/22* (2006.01)
*H01R 13/11* (2006.01)
*H01R 13/42* (2006.01)

(52) U.S. Cl.
CPC ..... *H01R 13/113* (2013.01); *H01R 13/42* (2013.01)

(58) Field of Classification Search
CPC ... H01R 13/187; H01R 13/111; H01R 13/113; H01R 9/091; H01R 13/11; H01R 13/112
USPC ..... 439/843, 851–857
See application file for complete search history.

(56) References Cited

U.S. PATENT DOCUMENTS 5,611,716 A * 3/1997 Egenolf ..... H01R 13/11 439/752
5,897,405 A * 4/1999 Endo ..... H01R 13/11 439/852
5,989,078 A * 11/1999 Chaillot ..... H01R 43/16 439/851
6,305,993 B1 * 10/2001 Heimueller ..... H01R 13/11 439/852
6,524,142 B2 * 2/2003 Heimueller ..... H01R 13/113 439/843

(Continued)

FOREIGN PATENT DOCUMENTS

EP 1345287 A1 9/2003
EP 1981125 A1 10/2008

(Continued)

*Primary Examiner* — Thanh Tam Le
(74) *Attorney, Agent, or Firm* — Muncy, Geissler, Olds & Lowe, P.C.

(57) ABSTRACT

A connector terminal includes a contact portion to be contacted with a counter connector terminal, a hold portion held in a connector housing, and a coupling portion coupling the contact portion and the hold portion, the coupling portion being configured as a rectangular tube with four bending portions and having a single continuous band portion from the contact portion to the hold portion by having notches staggered from the contact portion toward the hold portion, each of the notches including an oblique part that extends to cross over adjacent two of the four bending portions, the oblique part of an odd numbered notch being slanted in a direction from the contact portion toward the hold portion as approaching a tip from an entrance thereof, an even numbered notch being slanted in a direction from the hold portion toward the contact portion as approaching a tip from an entrance thereof.

9 Claims, 7 Drawing Sheets

(56) References Cited

U.S. PATENT DOCUMENTS

| | | | | |
|---|---|---|---|---|
| 7,059,921 | B2 * | 6/2006 | Mulot | H01R 13/11 439/852 |
| 7,144,281 | B2 * | 12/2006 | Maeda | H01R 13/113 439/852 |
| 7,252,561 | B2 * | 8/2007 | Nora | H01R 13/4223 439/852 |
| 9,570,854 | B2 * | 2/2017 | Hashimoto | H01R 13/113 |

FOREIGN PATENT DOCUMENTS

| | | | |
|---|---|---|---|
| FR | 2758213 | A1 | 7/1998 |
| JP | 2010-061962 | A | 3/2010 |
| WO | WO2014096885 | A1 | 6/2014 |

* cited by examiner

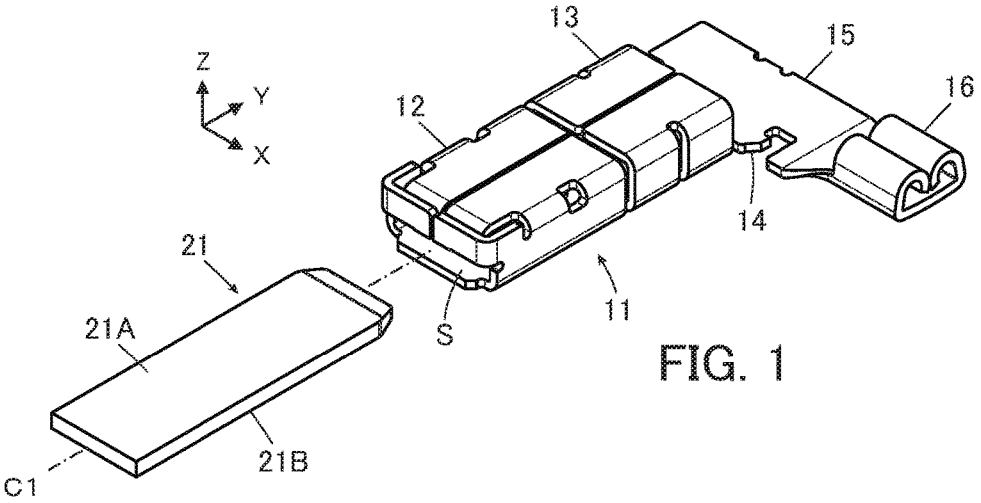
FIG. 1
FIG. 2
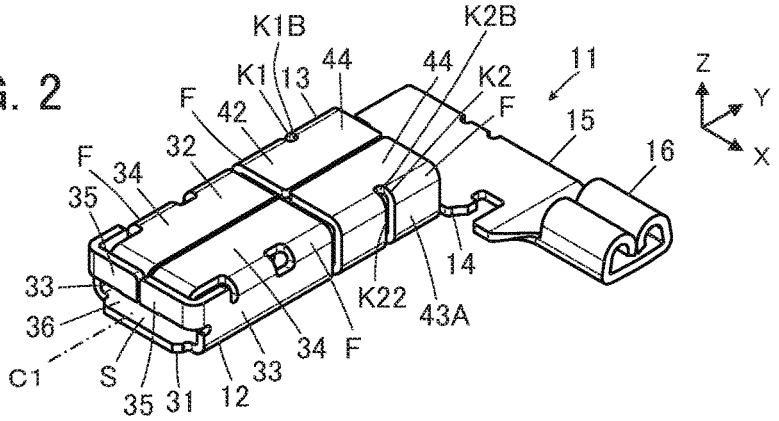
FIG. 3
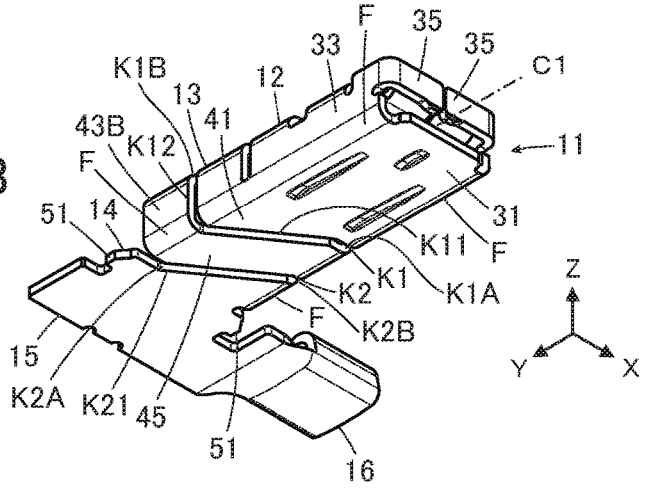

CONNECTOR TERMINAL AND ELECTRIC CONNECTOR

BACKGROUND OF THE INVENTION

The present invention relates to a connector terminal, particularly to a connector terminal having a contact portion that comes into contact with a counter connector terminal and a hold portion that is held in a connector housing.

The invention also relates to an electric connector using a connector terminal.

In connectors where large current flows, such as a connector for a power supply, the configuration has heretofore widely been employed in which electric connection is established by inserting a plug terminal in a flat plate shape into a socket terminal in a box shape such that the plug terminal is sandwiched from top and bottom between a plurality of contact points of the socket terminal.

For instance, JP 2010-61962 A discloses a socket terminal 4 of a bus bar 3 to be connected to a flat plate shaped plug terminal 2 of a secondary cell 1 as shown in FIG. 19. The plug terminal 2 of the secondary cell 1 is held in a secondary cell-side housing 5 attached to the secondary cell 1 and projects in a recess 5A of the secondary cell-side housing 5. The socket terminal 4 of the bus bar 3 is held in a bus bar-side housing 6 and has two contact points 7 and 8 that project in a recess 6A of the bus bar-side housing 6 and face each other. Of the two contact points 7 and 8 of the socket terminal 4, one contact point 7 forms a spring contact point that is elastically displaceable in a direction toward the other contact point 8 in the recess 6A of the bus bar-side housing 6.

As shown in FIG. 20, upon insertion of the bus bar-side housing 6 of the bus bar 3 into the recess 5A of the secondary cell-side housing 5, the plug terminal 2 of the secondary cell 1 is inserted into the recess 6A of the bus bar-side housing 6 and sandwiched by the two contact points 7 and 8 of the socket terminal 4 from opposite sides. At this time, contact pressure occurs between the plug terminal 2 of the secondary cell 1 and the socket terminal 4 of the bus bar 3 owing to the contact point 7 of the socket terminal 4 that forms the spring contact point, and the plug terminal 2 of the secondary cell 1 and the socket terminal 4 of the bus bar 3 are fitted with each other to establish an electrically continuous state.

The use of the thus-configured bus bar 3 enables a plurality of secondary cells 1 to be electrically connected with each other.

Meanwhile, when vibration or the like is applied to the secondary cell 1 and the bus bar 3 in the state where the plug terminal 2 of the secondary cell 1 and the socket terminal 4 of the bus bar 3 are fitted with each other and the contact points 7 and 8 of the socket terminal 4 are in contact with the plug terminal 2 as shown in FIG. 20, contact parts of the socket terminal 4 and the plug terminal 2 may be moved relative to each other, resulting in poor contact. This occurs because, when the contact parts of the socket terminal 4 and the plug terminal 2 are moved and rubbed against each other, platings of the contact parts are peeled off, leading to corrosion of the contact parts and increase in contact resistance.

To cope with it, one possible measure is to, in the socket terminal 4 of the bus bar 3 shown in FIG. 19, provide a spring portion between a contact portion having the contact points 7 and 8 that come into contact with the plug terminal 2 of the secondary cell 1 and a hold portion held in the bus bar-side housing 6 such that the contact portion and the hold portion are coupled by the spring portion to be elastically displaceable. With this configuration, even when vibration or the like is applied, the spring portion deforms to thereby prevent relative movement of the contact parts. As a result, poor contact is less likely to occur.

However, while it is preferable that the spring portion with a longer spring length be provided between the contact portion and the hold portion in order to prevent poor contact from occurring, such a longer spring length causes increase in the distance from the contact portion to the hold portion, resulting in a larger connector.

SUMMARY OF THE INVENTION

The present invention has been made to overcome such a conventional problem and provide a connector terminal capable of preventing poor connection from occurring despite its small size.

The present invention is also aimed at providing an electric connector using a connector terminal.

A connector terminal according to the present invention comprises:

a contact portion that comes into contact with a counter connector terminal;

a hold portion that is held in a connector housing; and a coupling portion that is disposed between the contact portion and the hold portion and couples the contact portion and the hold portion such that the contact portion and the hold portion are elastically displaceable relative to each other, wherein the contact portion, the coupling portion and the hold portion are made of a single metal sheet, wherein the coupling portion is configured as a first rectangular tube having four bending portions parallel to each other and has a single band portion that continuously extends while bending from the contact portion to the hold portion by having a plurality of notches staggered from the contact portion toward the hold portion, wherein each of the plurality of notches includes an oblique part that extends to cross over adjacent two of the four bending portions in a direction oblique to the four bending portions and a perpendicular part that is connected to the oblique part and extends in a direction perpendicular to the four bending portions, wherein the oblique part included in an odd numbered notch of the plurality of notches when counted from the contact portion is slanted in a direction from the contact portion toward the hold portion as approaching a tip of the odd numbered notch from an entrance of the odd numbered notch, and wherein the oblique part included in an even numbered notch of the plurality of notches when counted from the contact portion is slanted in a direction from the hold portion toward the contact portion as approaching a tip of the even numbered notch from an entrance of the even numbered notch.

An electric connector according to present invention comprises:

the connector terminal as described above; and the connector housing holding the hold portion of the connector terminal.

BRIEF DESCRIPTION OF THE DRAWINGS

FIG. 1 is a perspective view showing a connector terminal according to Embodiment 1 and a counter connector terminal in a non-fitted state.

FIG. 2 is a perspective view showing the connector terminal according to Embodiment 1 when viewed from obliquely above.

FIG. 3 is a perspective view showing the connector terminal according to Embodiment 1 when viewed from obliquely below.

DETAILED DESCRIPTION OF THE INVENTION

Figure 4:
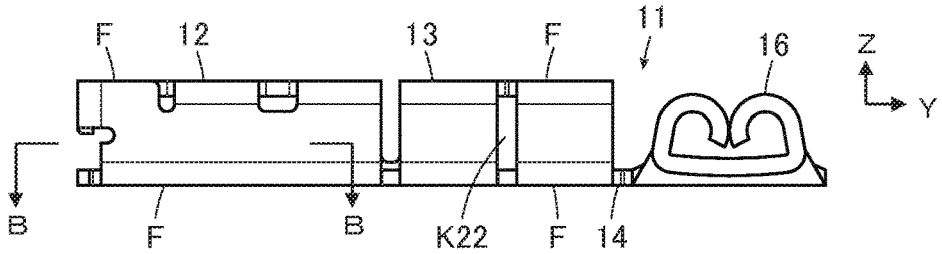
FIG. 4 is a side view showing the connector terminal according to Embodiment 1.

Embodiments of the present invention are described below based on the appended drawings. ps Embodiment 1

As shown in FIG. 1, a connector terminal 11 according to Embodiment 1 of the invention includes a tubular contact portion 12 having a counter connector terminal accommodating portion S formed therein, and a counter connector terminal 21 is a plug terminal in a flat plate shape. When the counter connector terminal 21 is inserted into the counter connector terminal accommodating portion S of the contact portion 12 of the connector terminal 11 along a fitting axis C1, the contact portion 12 comes into contact with the counter connector terminal 21, and the connector terminal 11 and the counter connector terminal 21 are fitted with each other, thus establishing electric connection.

The connector terminal 11 includes a coupling portion 13 that is disposed at the back end of the contact portion 12 along the fitting axis C1 and has a tubular shape similarly to the contact portion 12 and a hold portion 14 that is disposed at the back end of the coupling portion 13. The hold portion 14 is held in a connector housing to be described later to thereby hold the connector terminal 11 in the connector housing. The coupling portion 13 disposed between the contact portion 12 and the hold portion 14 has spring characteristics and couples the contact portion 12 and the hold portion 14 together such that the portions 12 and 14 are elastically displaceable relative to each other. The connector terminal 11 further includes a lead portion 15 extending from the hold portion 14 in a direction perpendicular to the fitting axis C1 and an electric wire connection portion 16 disposed at the tip of the lead portion 15.

For convenience, the direction in which the fitting axis C1 extends from the contact portion 12 to the coupling portion 13 is called "+Y direction," the direction in which the lead portion 15 extends from the hold portion 14 "+X direction," and the direction perpendicular to an XY plane "Z direction."

The counter connector terminal 21 is of a flat plate shape having a uniform thickness and extending along the XY plane. The counter connector terminal 21 includes a top surface 21A extending along the XY plane and facing in the +Z direction and a bottom surface 21B extending along the XY plane in parallel to the top surface 21A and facing in the −Z direction.

FIGS. 2 to 5 show the connector terminal 11.

The contact portion 12 is configured as a rectangular tube (second rectangular tube) that has four bending portions F parallel to the fitting axis C1 to surround the counter connector terminal accommodating portion S. The contact portion 12 has a bottom plate portion 31 and a ceiling portion 32 that extend along the XY plane and face each other, and a pair of lateral wall portions 33 that extend along a YZ plane. The ceiling portion 32 is divided at its middle portion along the fitting axis C1 into two upper plate portions 34, and the upper plate portions 34 are separately connected to the corresponding lateral wall portions 33.

At the front end of the contact portion 12, a pair of fence portions 35 are formed that are separately bent from the front ends of the corresponding lateral wall portions 33 to extend along an XZ plane. The fence portions 35 are smaller in height than the lateral wall portions 33 in the Z direction, and an insertion port 36 for receiving the counter connector terminal 21 is formed between the pair of fence portions 35 and the front end of the bottom plate portion 31.

The coupling portion 13 is configured as a rectangular tube (first rectangular tube) having four bending portions F that separately extend from the four bending portions F of the contact portion 12 in the +Y direction. The coupling portion 13 has a bottom plate portion 41 and a ceiling portion 42 that extend along the XY plane and face each other, and a lateral wall portion 43A on the +X direction side and a lateral wall portion 43B on the −X direction side that extend along the YZ plane. The ceiling portion 42 is divided at its middle portion along the fitting axis C1 into two upper plate portions 44.

The coupling portion 13 is provided with two notches that are staggered from the contact portion 12 toward the hold portion 14, that is, a first notch K1 formed near the contact portion 12 and a second notch K2 formed near the hold portion 14.

The first notch K1 starts from an entrance K1A located in the lateral wall portion 43A on the +X direction side in the vicinity of the contact portion 12, obliquely extends across the bottom plate portion 41 and ends at a tip K1B located in the lateral wall portion 43B on the −X direction side. The first notch K1 has an oblique part K11 extending in the bottom plate portion 41 in a direction oblique to the four bending portions F and a perpendicular part K12 extending in the lateral wall portion 43B on the −X direction side in the direction perpendicular to the four bending portions F. On the other hand, the second notch K2 starts from an entrance K2A located in the lateral wall portion 43B on the −X direction side in the vicinity of the hold portion 14, obliquely extends across the bottom plate portion 41 and ends at a tip K2B located in the lateral wall portion 43A on the +X direction side. The second notch K2 has an oblique part K21 extending in the bottom plate portion 41 in a direction oblique to the four bending portions F and a perpendicular part K22 extending in the lateral wall portion 43A on the +X direction side in the direction perpendicular to the four bending portions F.

The oblique part K11 of the first notch K1, which is an odd numbered notch when counted from the contact portion 12 side, is slanted in a direction from the contact portion 12 toward the hold portion 14 as, from the entrance K1A, approaching the tip K1B. The oblique part K21 of the second notch K2, which is an even numbered notch when counted from the contact portion 12 side, is slanted in a direction from the hold portion 14 toward the contact portion 12 as, from the entrance K2A, approaching the tip K2B. The oblique part K11 of the first notch K1 and the oblique part K21 of the second notch K2 extend parallel to each other, and owing to the first and second notches K1 and K2 as above, the coupling portion 13 has a single band portion 45 that continuously extends while bending in the X, Y and Z directions from the contact portion 12 to the hold portion 14 with a substantially uniform width. Because the band portion 45 of the coupling portion 13 elastically deforms, the contact portion 12 and the hold portion 14 are coupled to be elastically displaceable relative to each other in three dimensional directions.

The hold portion 14 disposed on the +Y direction side of the coupling portion 13 has a flat plate shape extending along the XY plane and includes a pair of projections 51 projecting separately in the +X and −X directions.

The lead portion 15 extending from the hold portion 14 in the +X direction is formed integrally with the hold portion 14 and has a flat plate shape extending along the XY plane. The electric wire connection portion 16 is coupled to the tip of the lead portion 15.

Figure 5:
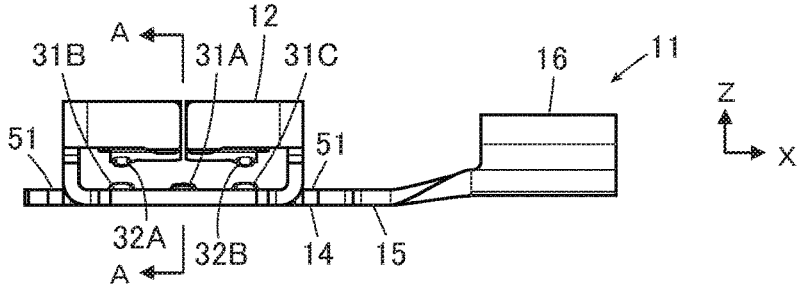
FIG. 5 is a front view showing the connector terminal according to Embodiment 1.
Figure 6:
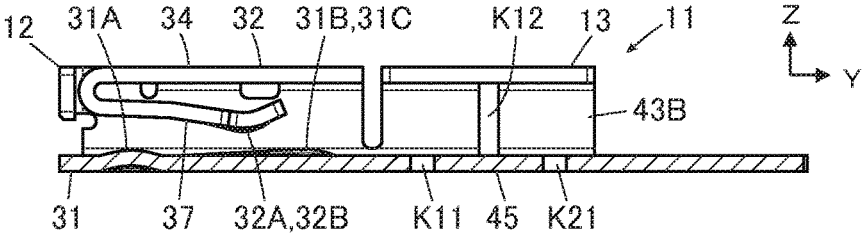
FIG. 6 is a cross-sectional view taken along line A-A in FIG. 5.

As shown in FIGS. 5 and 6, three bottom side contact points 31A to 31C are formed on the bottom plate portion 31 of the contact portion 12 so as to face in the +Z direction, while two top side contact points 32A and 32B are formed at the ceiling portion 32 of the contact portion 12 so as to face in the −Z direction.

Figure 7:
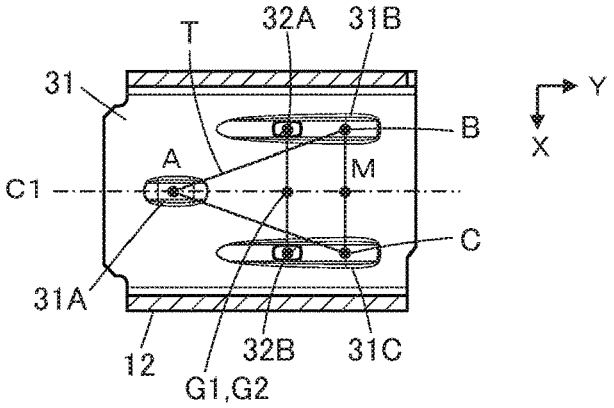
FIG. 7 is a cross-sectional view taken along line B-B in FIG. 4.

Each of the three bottom side contact points 31A to 31C has a dome shape, projects in the +Z direction inside the counter connector terminal accommodating portion S, and is a non-spring contact point that makes point contact with the bottom surface 21B of the counter connector terminal 21 when the counter connector terminal 21 is fitted with the connector terminal 11. As shown in FIG. 7, the three bottom side contact points 31A to 31C are arranged to form an isosceles triangle T in an XY plane with the bottom side contact point 31A being set as a vertex A and a line segment connecting the remaining bottom side contact points 31B and 31C being set as a base BC.

The base BC of the isosceles triangle T extends in the X direction, and a median AM connecting a midpoint M of the base BC to the vertex A of the isosceles triangle T extends in the Y direction. The isosceles triangle T is symmetrical with respect to a YZ plane passing through the median AM. The median AM of the isosceles triangle T is positioned on the same YZ plane as the YZ plane passing through the fitting axis C1, and the three bottom side contact points 31A to 31C are arranged symmetrically with respect to the YZ plane passing through the fitting axis C1.

Now, the center of gravity of the three bottom side contact points 31A to 31C is discussed. In general, when a uniform load is applied to each of plural points, the center of gravity of the plural points is to be a point that allows forces and moments resulting from the applied loads to be balanced, and can be defined as a point of action on which a resultant force of the loads applied to the plural points acts. For instance, when a load W1 acting in the −Z direction is applied to each of the three bottom side contact points 31A to 31C, moments associated with the loads W1 balance out at a geometrical center of gravity of the isosceles triangle T formed with the three bottom side contact points 31A to 31C, i.e., at a point that internally divides the median AM in the ratio 2:1, and a resultant force F1=3×W1 acting in the −Z direction is exerted on the point. Therefore, the point is referred to as a center of gravity G1 determined by the arrangement positions of the three bottom side contact points 31A to 31C.

As shown in FIG. 6, −Y direction ends of the two upper plate portions 34 in the ceiling portion 32 of the contact portion 12 are so bent back toward the inside of the contact portion 12 as to extend in the +Y direction, thus forming a pair of spring portions 37 having a cantilever shape in the counter connector terminal accommodating portion S. The two top side contact points 32A and 32B are separately disposed at the tips of the spring portions 37. The pair of spring portions 37 are the same in size and spring constant.

The top side contact points 32A and 32B are formed by working the tips of the spring portions 37. Each of the top side contact points 32A and 32B has a dome shape symmetrical with respect to a YZ plane passing through the top side contact point 32A or 32B, projects in the −Z direction inside the counter connector terminal accommodating portion S, and constitutes a spring contact point that makes point contact with the top surface 21A of the counter connector terminal 21 when the counter connector terminal 21 is fitted with the connector terminal 11.

The top side contact points 32A and 32B are positioned on a straight line extending in the X direction, and a midpoint of a line segment connecting the top side contact points 32A and 32B is positioned on the same YZ plane as the YZ plane passing through the fitting axis C1.

When a load W2 acting in the +Z direction is applied to each of the two top side contact points 32A and 32B, moments associated with the loads W2 balance out at the midpoint of the line segment connecting the top side contact points 32A and 32B, and a resultant force F2=2×W2 acting in the +Z direction is exerted on the midpoint. Therefore, the midpoint of the line segment connecting the top side contact points 32A and 32B is referred to as a center of gravity G2 determined by the arrangement positions of the two top side contact points 32A and 32B.

As shown in FIG. 7, the two top side contact points 32A and 32B are arranged so as not to coincide in position with any of the three bottom side contact points 31A to 31C when viewed in the Z direction. In addition, the bottom side contact points 31A to 31C and the top side contact points 32A and 32B are arranged such that, as viewed in the Z direction, the position of the center of gravity G2 determined by the arrangement positions of the top side contact points 32A and 32B coincides with the position of the center of gravity G1 determined by the arrangement positions of the three bottom side contact points 31A to 31C.

Figure 8:
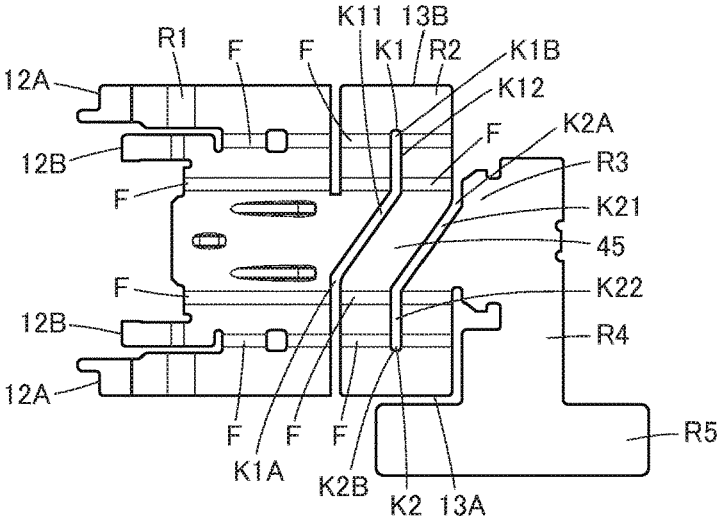
FIG. 8 is a development view of the connector terminal according to Embodiment 1.

The connector terminal 11 configured as above can be formed by cutting out a metal sheet into the shape shown in FIG. 8 and then bending the cut metal sheet. The metal sheet has a region R1 used for forming the contact portion 12, a region R2 used for forming the coupling portion 13, a region R3 used for forming the hold portion 14, a region R4 used for forming the lead portion 15, and a region R5 used for forming the electric wire connection portion 16.

The region R1 has two arm portions 12A used for forming the pair of spring portions 37 and the top side contact points 32A and 32B that are separately provided at the tips of the spring portions 37 in the contact portion 12, and two projections 12B used for forming the pair of fence portions 35.

In the region R2, the first notch K1 and the second notch K2 are staggered from the region R1 toward the region R3. To be more specific, the first notch K1 extends from the entrance K1A on one end 13A side of the region R2 toward the tip K1B on the other end 13B side, the one end 13A and the other end 13B being ends in the direction perpendicular to the four bending portions F; the first notch K1 has the oblique part K11 that is slanted toward the region R3 from the entrance K1A toward the tip K1B and the perpendicular part K12 that is connected to the oblique part K11 and extends in the direction perpendicular to the four bending portions F. On the other hand, the second notch K2 extends from the entrance K2A on the other end 13B side of the region R2 toward the tip K2B on the one end 13A side, and has the oblique part K21 that is slanted toward the region R1 from the entrance K2A toward the tip K2B and the perpendicular part K22 that is connected to the oblique part K21 and extends in the direction perpendicular to the four bending portions F, in the opposite manner to the first notch K1. Owing to the first and second notches K1 and K2, the band portion 45 is formed that continuously extends while bending from the region R1 to the region R3.

The region R1 is bent at the four bending portions F at right angle to form the contact portion 12 of rectangular tube shape, and the region R2 is bent at the four bending portions F at right angle to form the coupling portion 13 of rectangular tube shape.

The region R5 is bent to form the electric wire connection portion 16. The hold portion 14 and the lead portion 15 both in a flat plate shape are formed by using the regions R3 and R4 as they are.

Figure 9:
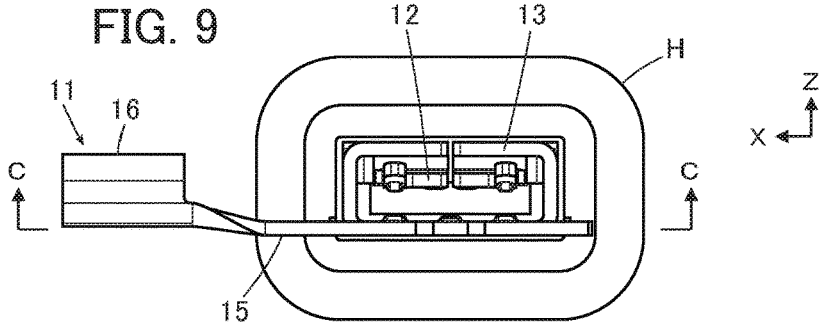
FIG. 9 is a back view showing an electric connector using the connector terminal according to Embodiment 1.
Figure 10:
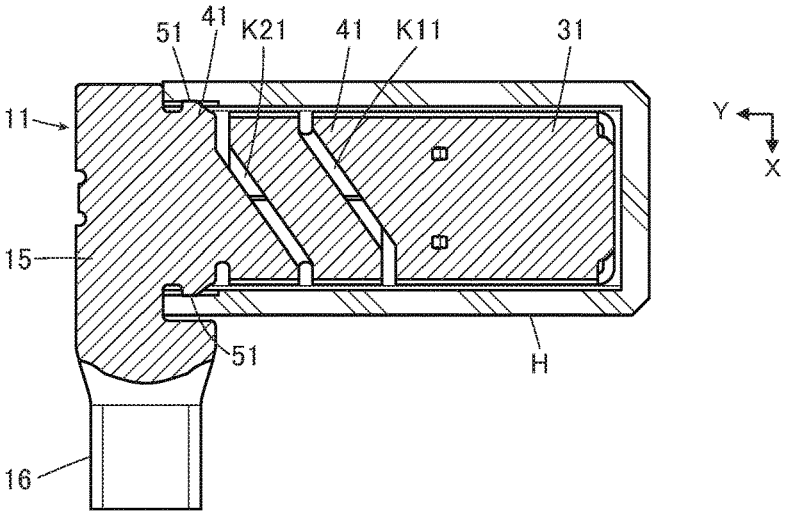
FIG. 10 is a cross-sectional view taken along line C-C in FIG. 9.

The connector terminal 11 according to Embodiment 1 is held in a connector housing H made of an insulating material such as an insulating resin as shown in FIG. 9 and thus used as an electric connector. The connector terminal 11 can be held in the connector housing H by press-fitting the pair of projections 51 of the hold portion 14 into the connector housing H in an XY plane, as shown in FIG. 10.

Next, the function of the connector terminal 11 in a fitting process is described.

Figure 11:
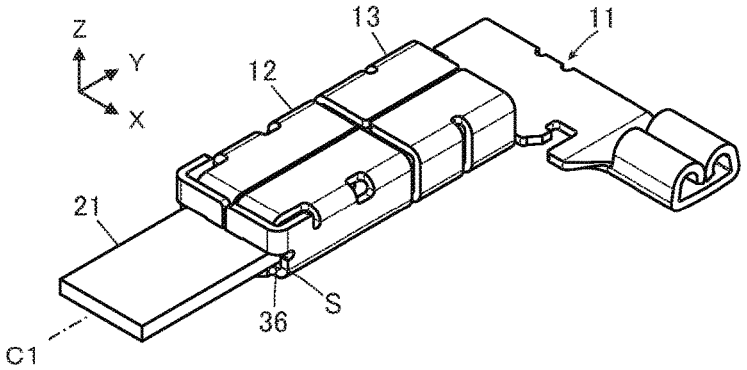
FIG. 11 is a perspective view showing the connector terminal according to Embodiment 1 and the counter connector terminal in a fitted state.
Figure 12:
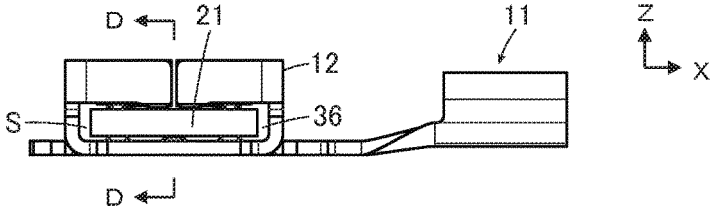
FIG. 12 is a front view of the connector terminal according to Embodiment 1 in the fitted state.
Figure 13:
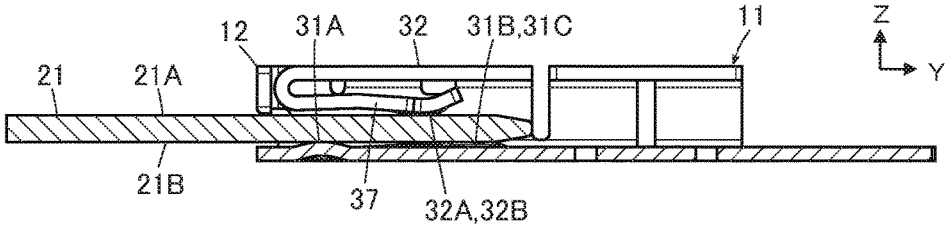
FIG. 13 is a cross-sectional view taken along line D-D in FIG. 12.

As shown in FIGS. 11 and 12, when the counter connector terminal 21 is inserted into the counter connector terminal accommodating portion S through the insertion port 36 of the contact portion 12 of the connector terminal 11, the two spring portions 37 of the contact portion 12 elastically deform as shown in FIG. 13, whereby the two top side contact points 32A and 32B disposed at the ceiling portion 32 of the contact portion 12 come into contact with the top surface 21A of the counter connector terminal 21 at a predetermined contact pressure, while the three bottom side contact points 31A to 31C disposed on the bottom plate portion 31 of the contact portion 12 come into contact with the bottom surface 21B of the counter connector terminal 21 at a predetermined contact pressure. Thus, the connector terminal 11 and the counter connector terminal 21 are electrically connected to each other. In FIGS. 11 to 13, the connector housing H is not illustrated in order to simplify the drawings.

As described above, the coupling portion 13 of the connector terminal 11 has the band portion 45 continuously extending from the contact portion 12 to the hold portion 14 while bending in the X, Y and Z directions and couples the contact portion 12 and the hold portion 14 together such that the portions 12 and 14 are elastically displaceable in three dimensional directions. Thus, when vibration or the like is applied to the connector terminal 11 and the counter connector terminal 21 in the electrically continuous state and an external force acts so as to relatively displace the connector housing H, which holds the connector terminal 11, and the counter connector terminal 21, the band portion 45 of the coupling portion 13 disposed between the hold portion 14 of the connector terminal 11 held in the connector housing H and the contact portion 12 of the connector terminal 11 being in contact with the counter connector terminal 21 at a predetermined pressure elastically deforms to absorb the external force.

The band portion 45 of the coupling portion 13 elastically deforms to absorb an external force when the contact portion 12 and the hold portion 14 are displaced relative to each other in the X, Y and Z directions and also when the portions 12 and 14 are twisted relative to each other about the X, Y and Z axes. This configuration prevents the top side contact points 32A and 32B of the contact portion 12 of the connector terminal 11 and the top surface 21A of the counter connector terminal 21 as well as the bottom side contact points 31A to 31C of the contact portion 12 of the connector terminal 11 and the bottom surface 21B of the counter connector terminal 21 from being rubbed against each other. Accordingly, it is possible to eliminate in advance the possibility that contact resistance between the connector terminal 11 and the counter connector terminal 21 increases to cause poor contact.

As shown in FIG. 8, the coupling portion 13 of rectangular tube shape having the band portion 45 that continuously extends from the contact portion 12 to the hold portion 14 while bending in the X, Y and Z directions is formed only by forming two narrow notches, namely, the first notch K1 and the second notch K2, in the substantially rectangular region R2 of the metal sheet and bending the region R2 at the four bending portions F at right angle. This configuration makes it possible to, while effectively using a material, i.e., a metal sheet, achieve the small connector terminal 11 in which the contact portion 12 and the hold portion 14 are coupled to be elastically displaceable relative to each other in three dimensional directions.

In addition, since the band portion 45 has a substantially uniform width from the contact portion 12 to the hold portion 14 by forming the two narrow notches in the substantially rectangular region R2, a wide connector terminal 11 suitable for high current flow can be easily formed.

Since the counter connector terminal 21 is of a flat plate shape having a uniform thickness and extending along an XY plane and the two spring portions 37 on which the top side contact points 32A and 32B are disposed are the same in size and spring constant, when the two spring portions 37 elastically deform upon insertion of the counter connector terminal 21, contact forces N0 having the same magnitude and acting in the −Z direction are separately exerted from the two top side contact points 32A and 32B of the contact portion 12 to the top surface 21A of the counter connector terminal 21. Therefore, the point of action of the resultant force (2×N0) of the two contact forces N0 is to be positioned at the center of gravity G2 determined by the arrangement positions of the two top side contact points 32A and 32B. Because of the law of action-reaction, loads N1 each having the same magnitude as that of the contact force N0 and acting in the +Z direction are separately exerted from the top surface 21A of the counter connector terminal 21 to the two top side contact points 32A and 32B.

Since the counter connector terminal 21 receives the resultant force (2×N0) of the contact forces N0 from the top side contact points 32A and 32B, loads acting in the −Z direction are separately exerted on the three bottom side contact points 31A to 31C of the contact portion 12 through the bottom surface 21B of the counter connector terminal 21. At this time, as described above, the position of the center of gravity G1 determined by the arrangement positions of the three bottom side contact points 31A to 31C coincides with the position of the center of gravity G2 determined by the arrangement positions of the two top side contact points 32A and 32B as viewed in the Z direction, and accordingly, the resultant force (2×N0) acting on the center of gravity G2 directly acts on the center of gravity G1. As a result, components of force having the same magnitude and acting in the −Z direction are separately exerted as loads on the three bottom side contact points 31A to 31C such that the balance of forces and the balance of moments are achieved. More specifically, a load N2 with a magnitude of (2×N0)/3 acts on each of the bottom side contact points 31A to 31C.

Thus, the load N2 uniformly acts on each of the three bottom side contact points 31A to 31C, which leads to reduced variation in contact resistance between the bottom side contact points 31A to 31C being in contact with the bottom surface 21B of the counter connector terminal 21 in a flat plate shape. Likewise, the load N1 uniformly acts on each of the two top side contact points 32A and 32B, which leads to reduced variance in contact resistance between the top side contact points 32A and 32B being in contact with the top surface 21A of the counter connector terminal 21 in a flat plate shape.

Thus, contact resistances at the bottom side contact points 31A to 31C of the contact portion 12 are made equal, and contact resistances at the top side contact points 32A and 32B are made equal, so that the possibility of poor contact further decreases.

While the contact portion 12 has the two top side contact points 32A and 32B, the number of top side contact points may be one. In this case, since only one top side contact point is provided, a center of gravity determined by the arrangement position of the top side contact point is to be the position of the top side contact point.

In the case of having the two top side contact points 32A and 32B as in Embodiment 1, however, when a moment in an XY plane acts on the counter connector terminal 21 fitted with the connector terminal 11, a frictional force is exerted from each of the two top side contact points 32A and 32B, which can prevent displacement of the counter connector terminal 21 in a rotational direction in the XY plane. Also when a moment about the fitting axis C1 acts on the counter connector terminal 21 fitted with the connector terminal 11, a normal force is generated from one of the top side contact points 32A and 32B to the counter connector terminal 21, so that the displacement of the counter connector terminal 21 in a rotational direction in an XZ plane can be minimized.

While the contact portion 12 has the three bottom side contact points 31A to 31C, the contact portion 12 may have a different configuration as long as it has three or more bottom side contact points each making point contact. Such three or more bottom side contact points, however, need to be arranged not in a straight line. This is because, when three or more bottom side contact points align in a straight line, those bottom side contact points cannot stably retain the counter connector terminal 21 in an XY plane.

Aside from that, while constituted of non-spring contact points, the three bottom side contact points 31A to 31C may be spring contact points as with the top side contact points 32A and 32B.

While in the connector terminal 11, the lead portion 15 extends from the hold portion 14 in the +X direction perpendicular to the fitting axis C1 and the electric wire connection portion 16 is disposed at the tip of the lead portion 15, the invention is not limited thereto. For instance, the lead portion 15 and the electric wire connection portion 16 may be arranged in order on the +Y direction side of the hold portion 14 along the fitting axis C1. In this case, the lead portion 15 may be omitted such that the electric wire connection portion 16 is directly coupled to the hold portion 14 on the +Y direction side thereof.

Embodiment 2

Figure 14:
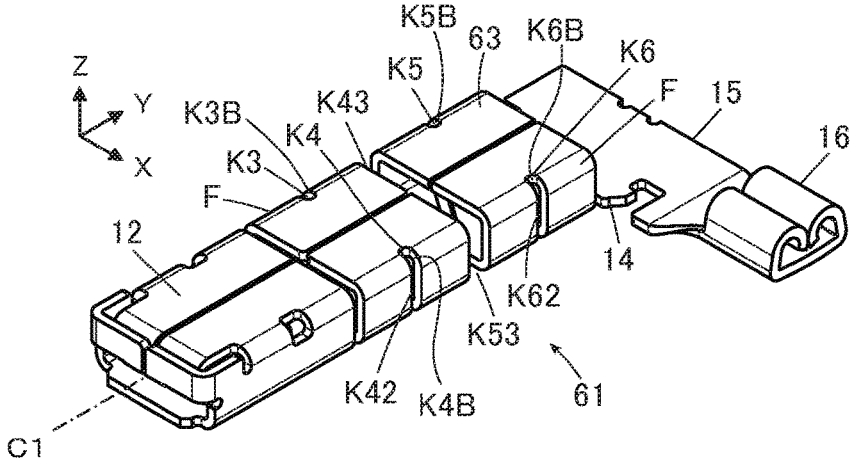
FIG. 14 is a perspective view showing a connector terminal according to Embodiment 2 when viewed from obliquely above.
Figure 15:
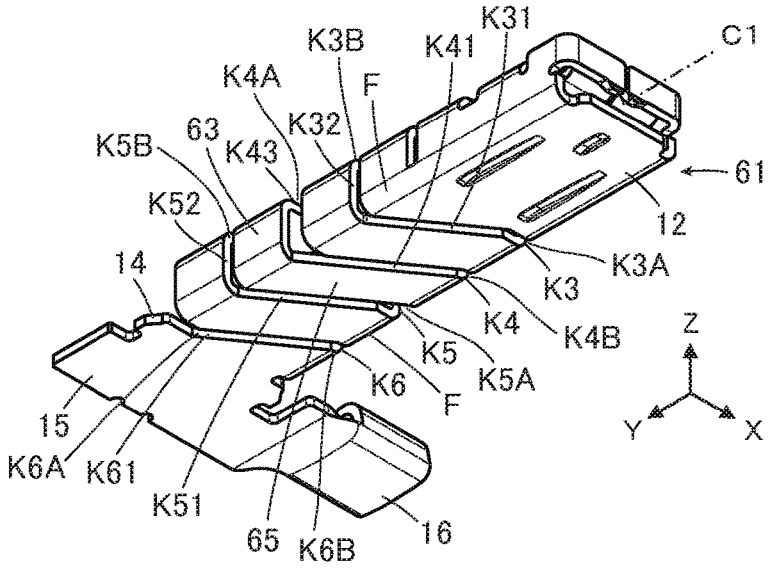
FIG. 15 is a perspective view showing the connector terminal according to Embodiment 2 when viewed from obliquely below.

FIGS. 14 and 15 show the structure of a connector terminal 61 according to Embodiment 2. The connector terminal 61 is the same as the connector terminal 11 in Embodiment 1 shown in FIGS. 2 and 3 except that a coupling portion 63 is disposed between the contact portion 12 and the hold portion 14 in place of the coupling portion 13 such that the contact portion 12 and the hold portion 14 are coupled by the coupling portion 63 to be elastically displaceable relative to each other.

The coupling portion 63 is configured as a rectangular tube (first rectangular tube) having four bending portions F and is provided with four notches K3 to K6 that are staggered from the contact portion 12 toward the hold portion 14.

The notch K3 formed near the contact portion 12 starts from an entrance K3A and ends at a tip K3B, and has an oblique part K31 extending in a direction oblique to the four bending portions F and a perpendicular part K32 connected to one end of the oblique part K31 and extending in the direction perpendicular to the four bending portions F.

The notch K4 adjacent to the notch K3 starts from an entrance K4A and ends at a tip K4B, and has an oblique part K41 extending in a direction oblique to the four bending portions F and perpendicular parts K42 and K43 connected to the opposite ends of the oblique part K41 and extending in the direction perpendicular to the four bending portions F.

The notch K5 adjacent to the notch K4 starts from an entrance K5A and ends at a tip KSB, and has an oblique part K51 extending in a direction oblique to the four bending portions F and perpendicular parts K52 and K53 connected to the opposite ends of the oblique part K51 and extending in the direction perpendicular to the four bending portions F.

The notch K6 that is adjacent to the notch K5 and is formed near the hold portion 14 starts from an entrance K6A and ends at a tip K6B, and has an oblique part K61 extending in a direction oblique to the four bending portions F and a perpendicular part K62 connected to one end of the oblique part K61 and extending in the direction perpendicular to the four bending portions F.

The oblique part K31 of the notch K3, which is an odd numbered notch when counted from the contact portion 12 side, is slanted in a direction from the contact portion 12 toward the hold portion 14 as, from the entrance K3A, approaching the tip K3B. Likewise, the oblique part K51 of the notch K5, which is an odd numbered notch when counted from the contact portion 12 side, is slanted in a direction from the contact portion 12 toward the hold portion 14 as, from the entrance K5A, approaching the tip K5B. On the other hand, the oblique part K41 of the notch K4, which is an even numbered notch when counted from the contact portion 12 side, is slanted in a direction from the hold portion 14 toward the contact portion 12 as, from the entrance K4A, approaching the tip K4B. Likewise, the oblique part K61 of the notch K6, which is an even numbered notch when counted from the contact portion 12 side, is slanted in a direction from the hold portion 14 toward the contact portion 12 as, from the entrance K6A, approaching the tip K6B.

The oblique parts K31 to K61 of the four notches K3 to K6 extend parallel to each other, and owing to the notches K3 to K6 thus staggered, the coupling portion 63 has a single band portion 65 that continuously extends from the contact portion 12 to the hold portion 14 while bending in the X, Y and Z directions. Because the band portion 65 of the coupling portion 63 elastically deforms, the contact portion 12 and the hold portion 14 are coupled to be elastically displaceable relative to each other in three dimensional directions. Accordingly, when vibration or the like is applied to the connector terminal 61 and the counter connector terminal 21 in the electrically continuous state, the band portion 65 of the coupling portion 63 elastically deforms, and it is therefore possible to eliminate in advance the possibility that contact resistance between the connector terminal 61 and the counter connector terminal 21 increases to cause poor contact, as is the case with the connector terminal 11 in Embodiment 1.

Figure 16:
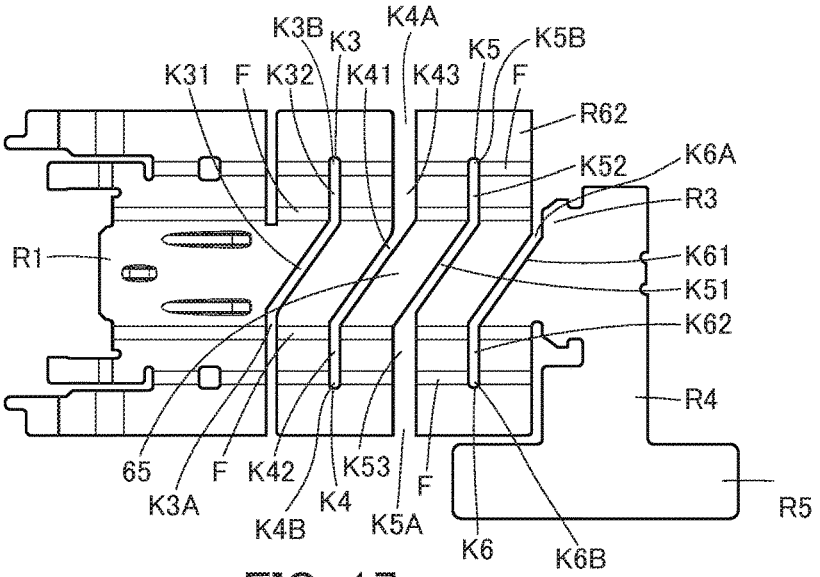
FIG. 16 is a development view of the connector terminal according to Embodiment 2.

The connector terminal 61 configured as above can be formed by cutting out a metal sheet into the shape shown in FIG. 16 and then bending the cut metal sheet. The metal sheet has a region R1 used for forming the contact portion 12, a region R62 used for forming the coupling portion 63, a region R3 used for forming the hold portion 14, a region R4 used for forming the lead portion 15, and a region R5 used for forming the electric wire connection portion 16. The four notches K3 to K6 are formed in the region R62.

The region R62 is bent at the four bending portions F at right angle to form the coupling portion 63 of rectangular tube shape.

In the connector terminal 61 according to Embodiment 2, the coupling portion 63 has the four notches K3 to K6 that are staggered from the contact portion 12 toward the hold portion 14, and this configuration makes it possible to have the band portion 65 with an increased length and form the coupling portion 63 with a small spring constant that is easily elastically deformable.

The number of notches provided in a coupling portion is not limited to two as in Embodiment 1 or four as in Embodiment 2 and may be three or five or more.

Embodiment 3

In the connector terminal 11 in Embodiment 1, the hold portion 14 has the pair of projections 51 that project separately in the +X and −X directions, and those projections 51 are press-fitted into the connector housing H in an XY plane such that the hold portion 14 is held in the connector housing H; however, the invention is not limited thereto.

Figure 17:
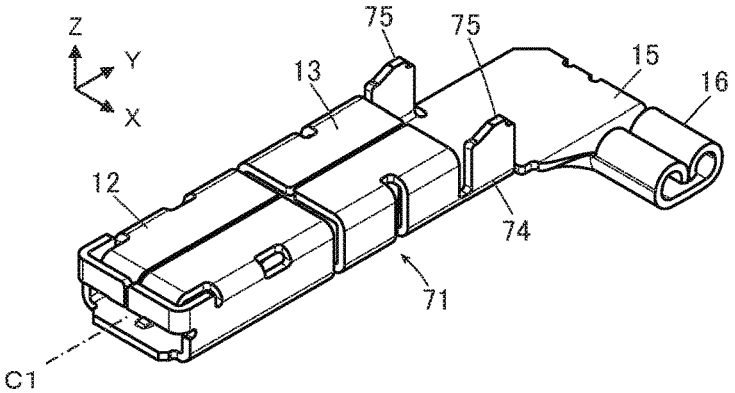
FIG. 17 is a perspective view showing a connector terminal according to Embodiment 3.

FIG. 17 shows the structure of a connector terminal 71 according to Embodiment 3. The connector terminal 71 is the same as the connector terminal 11 in Embodiment 1 shown in FIGS. 2 and 3 except that a hold portion 74 is disposed between the coupling portion 13 and the lead portion 15 in place of the hold portion 14. The hold portion 74 has a pair of projections 75 projecting in the +Z direction.

The pair of projections 75 as above are press-fitted into a connector housing (not shown) in a YZ plane, thereby holding the hold portion 74 in the connector housing.

Press-fit of a hold portion into a connector housing is not necessarily performed in an XY plane or a YZ plane but may be performed in, for example, an XZ plane.

A method of holding a hold portion of a connector terminal in a connector housing is not limited to press-fitting. For instance, as in a connector terminal 81 shown in FIG. 18, a hold portion 84 disposed between the coupling portion 13 and the lead portion 15 may have a screwing portion 86 that projects in the +Z direction in an XZ plane and has a securing hole 85 formed therein. In this case, the securing hole 85 is used to secure and hold the hold portion 84 in a connector housing (not shown) by a screw, a rivet or the like.

Figure 18:
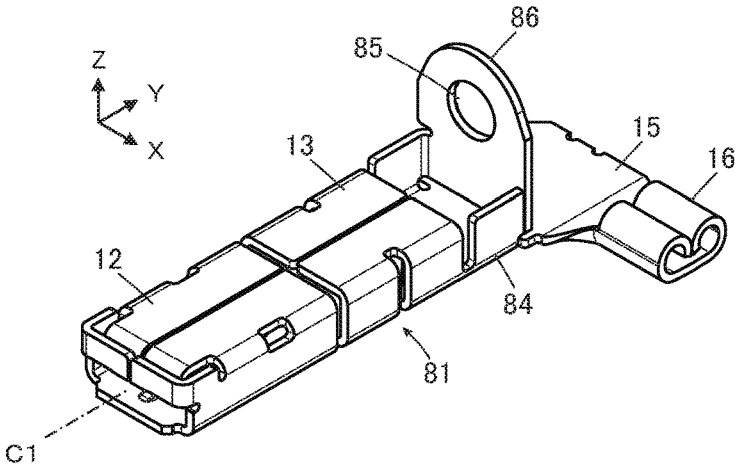
FIG. 18 is a perspective view showing a connector terminal according to a modification of Embodiment 3.
Figure 19:
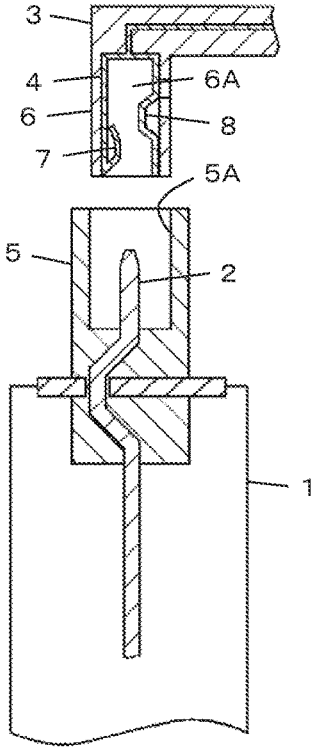
FIG. 19 PRIOR ART
FIG. 19 is a cross-sectional view showing a conventional connector terminal and a counter connector terminal in a non-fitted state.
Figure 20:
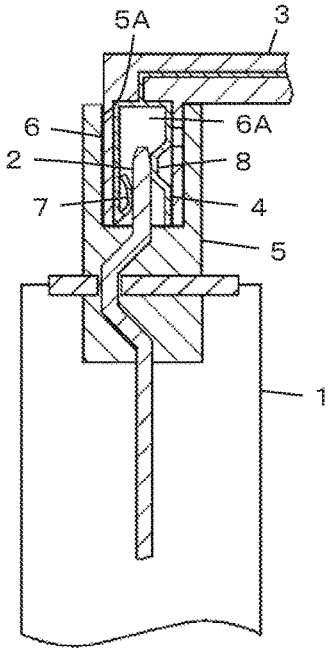
FIG. 20 PRIOR ART
FIG. 20 is a cross-sectional view showing the conventional connector terminal and the counter connector terminal in a fitted state.

The hold portion 74 shown in FIG. 17 or the hold portion 84 shown in FIG. 18 may be used in place of the hold portion 14 of the connector terminal 61 according to Embodiment 2.

What is claimed is:

1. A connector terminal comprising:

a contact portion that comes into contact with a counter connector terminal;

a hold portion that is held in a connector housing; and a coupling portion that is disposed between the contact portion and the hold portion and couples the contact portion and the hold portion such that the contact portion and the hold portion are elastically displaceable relative to each other, wherein the contact portion, the coupling portion and the hold portion are made of a single metal sheet, wherein the coupling portion is configured as a first rectangular tube having four bending portions parallel to each other and has a single band portion that continuously extends while bending from the contact portion to the hold portion by having a plurality of notches staggered from the contact portion toward the hold portion, the plurality of notches being separated from each other, wherein the first rectangular tube has a bottom plate potion, a first lateral wall portion, a ceiling portion and a second lateral wall portion which are adjacent to each other through corresponding one of the four bending portions, respectively, and the single band portion bends at the four bending portions to form the bottom plate portion, the first lateral wall portion, the ceiling portion and the second lateral wall portion, wherein each of the plurality of notches has an opened entrance end and a closed tip end, and includes an oblique part that extends to cross the bottom plate portion in a direction oblique to the four bending portions and a perpendicular part that is connected to the oblique part and extends to cross one of the first lateral wall portion and the second lateral wall portion in a direction perpendicular to the four bending portions, wherein the oblique part included in an odd numbered notch of the plurality of notches when counted from the contact portion is slanted in a direction from the contact portion toward the hold portion as approaching the closed tip end of the odd numbered notch from an entrance of the odd numbered notch, and wherein the oblique part included in an even numbered notch of the plurality of notches when counted from the contact portion is slanted in a direction from the hold portion toward the contact portion as approaching the closed tip end of the even numbered notch from the opened entrance end of the even numbered notch.

2. The connector terminal according to claim 1, wherein the oblique parts of the plurality of notches extend parallel to each other.

3. The connector terminal according to claim 1, wherein the contact portion is configured as a second rectangular tube having four bending portions that separately extend from the four bending portions of the first rectangular tube constituting the coupling portion.

4. The connector terminal according to claim 1, wherein the contact portion comes into contact with the counter connector terminal when the counter connector terminal in a flat plate shape having a top surface and a bottom surface is fitted with the connector terminal, and wherein the contact portion includes:

one or more top side contact points each of which makes point contact with the top surface of the counter connector terminal; and three or more bottom side contact points each of which makes point contact with the bottom surface of the counter connector terminal and which are not aligned in a straight line, the one or more top side contact points do not coincide in position with any of the three or more bottom side contact points when viewed in a direction perpendicular to the top surface of the counter connector terminal in a fitted state, and a position of a center of gravity as determined by arrangement positions of the one or more top side contact points coincides with a position of a center of gravity as determined by arrangement positions of the three or more bottom side contact points when viewed in the direction perpendicular to the top surface of the counter connector terminal in the fitted state.

5. The connector terminal according to claim 1, wherein the hold portion has a press-fit projection for use in press-fitting into the connector housing.

6. The connector terminal according to claim 1, wherein the hold portion has a screwing portion for use in securing to the connector housing by a screw.

7. An electric connector comprising:

the connector terminal according to claim 1; and the connector housing holding the hold portion of the connector terminal.

8. A connector terminal comprising:

a contact portion that comes into contact with a counter connector terminal;

a hold portion that is held in a connector housing; and a coupling portion that is disposed between the contact portion and the hold portion and couples the contact portion and the hold portion such that the contact portion and the hold portion are elastically displaceable relative to each other, wherein the contact portion, the coupling portion and the hold portion are made of a single metal sheet, wherein the coupling portion is configured as a first rectangular tube having four bending portions parallel to each other and has a single band portion that continuously extends while bending from the contact portion to the hold portion by having a plurality of notches staggered from the contact portion toward the hold portion, wherein each of the plurality of notches includes an oblique part that extends to cross over adjacent two of the four bending portions in a direction oblique to the four bending portions and a perpendicular part that is connected to the oblique part and extends in a direction perpendicular to the four bending portions, the oblique parts of the plurality of notches extend parallel to each other, wherein the oblique part included in an odd numbered notch of the plurality of notches when counted from the contact portion is slanted in a direction from the contact portion toward the hold portion as approaching the closed tip end of the odd numbered notch from an entrance of the odd numbered notch, and wherein the oblique part included in an even numbered notch of the plurality of notches when counted from the contact portion is slanted in a direction from the hold portion toward the contact portion as approaching the closed tip end of the even numbered notch from the opened entrance end of the even numbered notch.

9. A connector terminal comprising:

a contact portion that comes into contact with a counter connector terminal;

a hold portion that is held in a connector housing; and a coupling portion that is disposed between the contact portion and the hold portion and couples the contact portion and the hold portion such that the contact portion and the hold portion are elastically displaceable relative to each other, wherein the contact portion, the coupling portion and the hold portion are made of a single metal sheet, wherein the coupling portion is configured as a first rectangular tube having four bending portions parallel to each other and has a single band portion that continuously extends while bending from the contact portion to the hold portion by having a plurality of notches staggered from the contact portion toward the hold portion, wherein the contact portion is configured as a second rectangular tube having four bending portions that separately extend from the four bending portions of the first rectangular tube constituting the coupling portion, wherein each of the plurality of notches includes an oblique part that extends to cross over adjacent two of the four bending portions in a direction oblique to the four bending portions and a perpendicular part that is connected to the oblique part and extends in a direction perpendicular to the four bending portions, wherein the oblique part included in an odd numbered notch of the plurality of notches when counted from the contact portion is slanted in a direction from the contact portion toward the hold portion as approaching the closed tip end of the odd numbered notch from an entrance of the odd numbered notch, and wherein the oblique part included in an even numbered notch of the plurality of notches when counted from the contact portion is slanted in a direction from the hold portion toward the contact portion as approaching the closed tip end of the even numbered notch from the opened entrance end of the even numbered notch.

* * * * *